United States Patent [19]

Urban

[11] Patent Number: 4,717,795

[45] Date of Patent: Jan. 5, 1988

[54] PRECISION SNAP-ACTION SWITCH WITH STIFFENING RIBS BETWEEN AN ACTUATING BULGE AND SUPPORT FOR THE ACTUATING SPRING ELEMENT

[75] Inventor: Jozsef Urban, Budapest, Hungary

[73] Assignee: Kontakta Alkatreszgyar, Budapest, Hungary

[21] Appl. No.: 790,857

[22] Filed: Oct. 24, 1985

[51] Int. Cl.[4] ..... H01H 13/36

[52] U.S. Cl. ..... 200/67 DA; 200/275

[58] Field of Search ..... 200/67 D, 67 DA, 275

[56] References Cited

U.S. PATENT DOCUMENTS

| | | | |
|---|---|---|---|
| 2,340,615 | 2/1944 | Rath | 200/67 DA |
| 2,469,686 | 5/1949 | Eaton | 200/67 D |
| 2,631,205 | 3/1953 | Millard | 200/67 D |
| 2,697,145 | 12/1954 | Winet | 200/67 D |
| 2,701,475 | 2/1955 | Readeker | 200/67 D X |
| 2,767,270 | 10/1956 | Perkins | 200/67 D |
| 3,270,156 | 8/1966 | Stewart | 200/67 D |
| 3,290,464 | 12/1966 | Finnegan et al. | 200/67 D |
| 3,809,834 | 5/1974 | Hipple | 200/67 D |
| 4,278,855 | 7/1981 | Rossi | 200/67 D |

FOREIGN PATENT DOCUMENTS

| | | | |
|---|---|---|---|
| 958754 | 5/1964 | United Kingdom | 200/67 D |

OTHER PUBLICATIONS

Omrom Tateisi Electronics "Basic Switches" Brochure, 1985.

Honeywell Switch Catalogue "B311", 1978.

Omron Tateisi Electronics" Type 2 General Purpose Basic Switch" pp. 1-36, 1970.

*Primary Examiner*—Henry J. Recla

*Assistant Examiner*—Ernest G. Cusick

*Attorney, Agent, or Firm*—Karl F. Ross; Herbert Dubno

[57] ABSTRACT

A precision snap-action switch has a case containing a pair of fixed contacts and a unitary three-arm snap-action member with a pair of outer parallel spring arms, an inner arm parallel to the spring arms having a central longitudinal axis, and a crosspiece connecting ends of the arms opposite free ends thereof and formed in alignment with the inner arm with a double contact positioned beteen the fixed contacts and alternately engageable therewith. Respective tilting bearings engage the free ends of the outer spring arms to maintain them arched. The free end of the inner arm is fixed to the case and is formed immediately adjacent its attachment point and on the axis with a throughgoing section-reducing hole. An actuator movably mounted on the case engages the inner arm between the hole and the double contact for bending the inner arm substantially only at the hole to snap it over from engagement of the double contact with one of the fixed contacts to engagement with the other fixed contact. A generally point-shaped bulge formed at the axis unitarily on the inner arm of engages this bulge and stiffening rib formed unitarily on the inner arm extends along the longitudinal axis of the inner arm between the bulge and the hole so that the inner arm is substantially nonbendable by the bearing surface at the stiffening rib.

5 Claims, 5 Drawing Figures

PRECISION SNAP-ACTION SWITCH WITH STIFFENING RIBS BETWEEN AN ACTUATING BULGE AND SUPPORT FOR THE ACTUATING SPRING ELEMENT

FIELD OF THE INVENTION

The invention relates to a precision snap-action switch including a three-lever snap-action mechanism consisting of an actuated element and a spring element; the actuated element provided with a moving double contact is acted upon by an actuator and fixed on the case or the cover of the snap-action switch by its opposite end while one end of the arched spring element is supported in a tilting bearing.

BACKGROUND OF THE INVENTION

Snap-action switches generally and precision snap-action switches in particular are produced and distributed by many manufacturers with internationally standardized dimensions so that the snap-action mechanism of these switches have had the same dimensions for many years. Constructional and characteristical features of such switches are described e.g. in the Catalogue No. Z-007 of OMRON Tateisi Electronics Co., Japan issued on May, 1970, or in any "Basic switches Catalogue" of Honeywell, U.S. The actuated element of the snap-action mechanism is expanded in the ground state by the arched spring element laying on both sides of the inner actuated element. The opposite end of the spring element is supported in a tilting bearing while the free end of the actuated element is fixed on the case of the switch. On the common part of the actuated element and the spring element a moving contact, generally a double contact, is arranged between a fixed contact which is normally closed (N.C.) and a fixed contact which is normally open (N.O.). The actuator, having an operating axis perpendicular to the longitudinal axis of the snap-action switch, is provided with a convex, practically point-shaped actuating surface. The actuator bends the actuated element near the common axis of the tilting bearing of the spring element during the operation and after reaching the dead-point position the actuated element snaps over and the moving contact snaps into engagement with the fixed contact N.O. during existance application of the operating force. After relief of the operating force, the snap-action mechanism snaps back from the operating position to its original position. Another type of snap-action switches is known wherein the middle lever of the snap-action mechanism is formed as an arched spring element while both the outer actuated elements are bound in the zone of the moving contact and in the contacting zone of the actuator.

One of the most difficult things to achieve with the known snap-action switches is a reduced contact movement and force differential without reduction of contact separation. Because of reduction of the contact separation the movement differential decreases, so that the force differential and the operating force decrease. Reduction of contact separation has a disadvantageous reaction on the power characteristics, since decrease of the operating force goes with the decrease of the contact force which increases the possibility of the burning of the contacts. Burning of the contacts has a negative effect on the power characteristics of the snap-action switch. Switches of the prior art have the disadvantage that, upon use of the switch in D.C. circuits and with a voltage higher than the arc-striking voltage, the contact of the negative pole tapers on the occasion of the arc-striking so that the small contact separation disappears after relatively few operating cycles and the switch becomes unable to switch through.

Because of the aforementioned drawbacks standard specifications limit the reduction of the contact separation, for that very reason it is impossible to attain more advantageous movement differentials and force differentials with the snap-action mechanism of the known switches than with a snap-action mechanism having a contact separation e.g. of 0.5 mm.

OBJECT OF THE INVENTION

The object of the invention is to eliminate the enumerated drawbacks and to improve the movement differential and force differential characteristics of snap-action switches and to ensure the same movement differential characteristics with less force differential while maintaining the contact force using known double minimum contact separation.

SUMMARY OF THE INVENTION

The invention is based on my discovery that this goal can be easily reached by eliminating or reducing to the minimum of the harmful actions of a force and forces of friction between the actuated element and the spring element.

The subject of the inventions a precision snap-action switch including a three-lever snap-action mechanism consisting of an actuated element and a spring element, the actuated element provided with a double contact is in connection with an actuator and fixed on the case or cover of the snap-action switch by its opposite end while one end of the arched spring element is supported in a tilting bearing. This snap-action switch, according to the invention, has a point-shaped bulge formed on the actuated element of its own material at the contacting place of the actuator, moreover the actuator has a planar operating surface.

Because of the performance of the actuated element the moving differential characteristic can be improved and the snap properties of the snap-action switch become more advantageous, because no harmful force is effective upon the actuated element in a direction perpendicular to the longitudinal axis of the actuator.

It is advantageous according to the invention when on the actuated element in the zone between its point of attachment by a rivet and the bulge there is a stiffening formed of its own material and parallel to the longitudinal axis of the actuated element. Due to the stiffening the operating place, i.e. the point-shaped bulge can be placed at a greater distance from the fixing point. This results in advantageous contact force and less loading of the actuated element.

With a further preferred embodiment of the invention the bulge on the actuated element is in contact with an actuator having an axis parallel to the longitudinal axis of the snap-action switch and an operating surface in a form of a lateral face of a truncated pyramid (frustopyramid) merging into a lateral face of a rectangular prism.

It is further advantageous according to the invention when the actuator is formed as a disc with bistable positions with detent slots of the disc being selectively engageable by a detent spring. Due to this feature the snap-action switch according to the invention is suitable for operating with excessive overtravel without change in the switch characteristics and damage of the snap-action mechanism.

BRIEF DESCRIPTION OF THE DRAWING

Further features of the invention will be described in detail with reference to the accompanying drawing showing some preferred embodiments of the snap-action switch. In the drawing.

SPECIFIC DESCRIPTION

Figure 1:
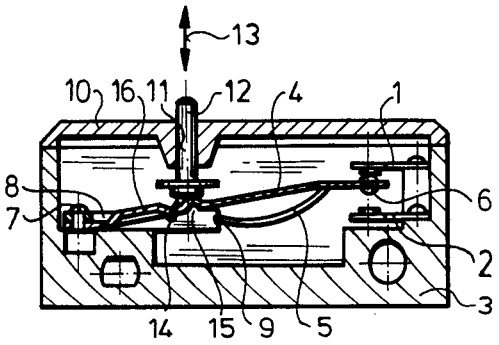
FIG. 1 is a longitudinal section of a preferred embodiment of the snap-action switch according to the invention.

As may be seen in FIG. 1, a fixed contact 1 N.C. (normally closed) and another fixed contact 2 N.O. (normally open) of a snap-action switch are fixed in a case 3. An inner actuated element 4 of the three-lever snap-action mechanism lies between two outer spring elements 5 and is provided with a moving double contact 6 on its one end while its other free end is fixed e.g. riveted by a rivet 7 (forming the fixing means of this invention) on the case 3 of the snap-action switch. The free ends of the spring elements 5 are supported in V-shaped flutes of tilting bearings 9 of support 8 which forms the support means of this invention. The spring element 5 which is unitary with the actuated element 4, is bent in a manner which may be seen in FIG. 1. The tilting bearing 9 can, alternatively, be formed out of the material of the case 3, so that use of support 8 is rendered unnecessary. An actuator 12—usually a plunger—is led through a bore 11 formed in a cover 10 of the snap-action switch. The actuator 12 movable in the direction of an arrow 13 has an operating surface 14 acting upon the actuated element 4, or rather, with a point-shaped bulge 15 with a diameter of maximum 1.0 mm formed unitarily from the material of the actuated element 4. The bulge 15 has in this case a form of a calotte, of course, it can be formed as a spherical segment or a cone. On the actuated element 4, in the region between rivet 7 and bulge 15 a stiffening 16 (e.g. a rib or corrugation) with a length of e.g. 5 mm is formed from the material of the actuated element 4 and parallel to the longitudinal axis of the actuated element 4 and, as illustrated, over most of the distance between the bulge 15 and the support for the uniform-thickness strip forming the actuated element.

Figure 2:
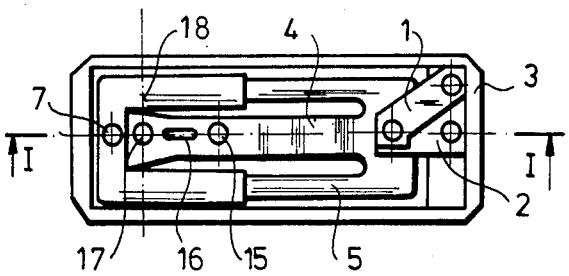
FIG. 2 is a top view of the snap-action switch of FIG. 1 without the cover.

FIG. 2 is a top view of the snap-action switch without the cover 10. A further hole 17 is formed in the actuated element 4 between the rivet 7 and the stiffening rib 16. This hole 17 determines the bending axis 18 of the actuated element 4 by local reduction of the cross section of the actuated element 4. In the ground state of the snap-action switch according to the invention no operating force acts upon the actuator 12 so that the moving contact 6 is pressed to the fixed contact N.C. 1. By pressing the actuator 12 in the direction of the arrow 13 the snap-action mechanism snaps over and the moving contact 6 snaps against the fixed contact N.O. 2 very quickly at a constant speed. During that time the planar operating surface 14 of the actuator 12 bears against the point-shaped bulge 15 on the actuated element 4 and the actuator can slide and twist on this bulge 15 without resulting in a reaction force perpendicular to the direction of the arrow 13. Because of the stiffening rib 16 on the actuated element 4 the movement differential, i.e. hysteresis of the switch can be reduced.

Figure 3:
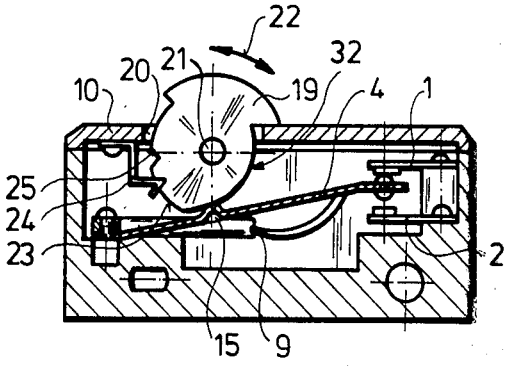
FIG. 3 is a longitudinal section of an embodiment with a rigid actuator having bistable positions and increased overtravel.

FIG. 3 shows a longitudinal section of another embodiment of the snap-action switch according to the invention provided with an actuator 19 formed as a bistable disc with two operation positions. The actuator 19 projects through an aperture 20 in the cover 10 of the switch and is pivotally mounted on an axle 21. The disc has a circumferential operating surface 23 with a radius larger than the radii of the other circumferential surfaces of the disc. In the ground state of the switch the bulge 15 of the actuated element 4 is in contact with the circumferential but non-operating surface 23 of the actuator 19 so that no operating force is effected. Upon rotation of the actuator 19 in the direction of an arrow 22, the operating surface 23 of the disc presses the actuated element 4 through the bulge 15 and the snap-action mechanism snaps over, i.e. the moving contact 6 snaps against the fixed contact N.O. 2. Both stable positions of the actuator 19 are determined by a detent spring 24 fixed on the case 3 or, in that case, on the cover 10 and cooperating with one of the slots 25 formed in the disc.

Figure 4:
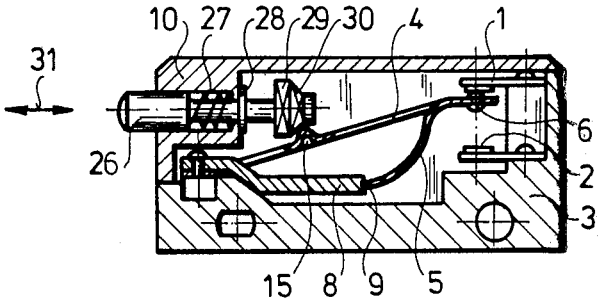
FIG. 4 is a sectional view (along line IV—IV of FIG. 5) of an embodiment provided with a snap-action mechanism having an inner spring element and a double outer actuated element.
Figure 5:
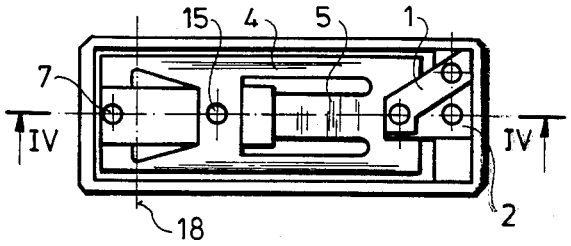
FIG. 5 is a top view of the switch of FIG. 4 with its cover removed.

A drawback of the snap-action switches provided with a actuator having an operating axis perpendicular to the longitudinal axis of the switch is the strictly toleranced overtravel, i.e. the distance which the actuator is permitted to travel after actuation. Exceeding this travel which may be 0.13 mm in practice, causes a greater deflection of actuated element that results in decrease of contact force and shortened lifetime of the switch. This problem is solved by the embodiment of the snap-action switch shown in FIGS. 4 and 5. FIG. 4 shows a longitudinal section of the switch wherein an actuator 26 is slidable arranged in a bore of the cover 10. The operating axis of the actuator 26 is parallel to the longitudinal axis of the switch and is held in ground state by a helical spring 27 which is mounted concentrical on the axle of the actuator 26 while its another end rests on the cover 10. A shoulder 28 of the actuator 26 rests on the inner side of the cover 10. The actuator 26 has an operating surface in a form of a lateral face of a truncated pyramid 30 merging into a lateral face of a rectangular prism 29. The operating surface presses the actuated element 4 through the bulge 15 during operation and the snap-action mechanism snaps over. The latter embodiment has a three-lever snap-action mechanism wherein the spring element 5 is the inner lever and the outer lever form the actuated element 4. The outer levers of the actuated element 4 are bound in the zone of the moving contact 6 and in the contacting zone of the actuator 26. After snapping the snap-action mechanism the operating surface i.e. the lateral face of the truncated pyramid 30 merges into a lateral face of a rectangular prism 29 during moving the actuator 26 in the direction of an arrow 31 and ensures the switching with an overtravel of e.g. 0.13 mm by any movement of the actuator 26.

The mentioned overtravel of limited value of e.g. 0.13 mm can ensured by the embodiment shown in FIG. 3 to the extent that the operating surface 23 of the actuator 19 has a constant radius.

I claim:

1. A precision snap-action switch comprising:

a switch case having a pair of sides;

a pair of fixed contacts spaced apart in said case at one of the sides thereof;

a unitary three-arm snap-action member in said case and comprising a pair of outer parallel spring arms each having a free end, an inner arm parallel to said spring arms and having a free end and a central longitudinal axis, and a crosspiece connecting ends of said arms opposite the free ends thereof, said crosspiece being formed in alignment with said inner arm with a double contact positioned between said fixed contacts and alternately engageable therewith;

support means in said case forming respective tilting bearings for each of the free ends of said outer spring arms and maintaining said outer spring arms arched;

fixing means engaged with said free end of said inner arm for affixing said free end of said inner arm to said case at an opposite side thereof, the free end of the inner arm being formed immediately adjacent said fixing means and on the axis with a throughgoing section-reducing hole;

an actuator movably mounted on said case and having a bearing surface engageable with said inner arm at a location between said hole and said double contact for causing said inner arm to bend substantially only at the hole and snap over from engagement of said double contact with one of said fixed contacts to engagement with the other of said fixed contacts;

a generally point-shaped bulge formed at the axis unitarily on said inner arm of the material thereof at said location and slidably engaging said surface, the bearing surface being engageable only with the bulge; and a stiffening rib formed unitarily on said inner arm from material thereof and extending along the longitudinal axis of said inner arm between said bulge and said hole and spaced from said bulge and from said hole, the inner arm being substantially nonbendable by the bearing surface at the stiffening rib.

2. The snap-action switch defined in claim 1 wherein the actuator is a pin displaceable in said case generally perpendicular to said bearing surface and said bearing surface is planar.

3. The snap-action switch defined in claim 2 wherein said support means is formed with a pair of flutes receiving said free ends of said spring arm.

4. The snap-action switch defined in claim 3 wherein said support means is a support member affixed to said case.

5. The snap-action switch defined in claim 1 wherein said fixing means is a rivet traversing said free end of said inner arm.

* * * * *